US006404113B1

(12) United States Patent
Okamoto

(10) Patent No.: US 6,404,113 B1
(45) Date of Patent: Jun. 11, 2002

(54) FIELD EMISSION TYPE COLD CATHODE ELEMENT, METHOD OF FABRICATING THE SAME, AND DISPLAY DEVICE

(75) Inventor: Akihiko Okamoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/487,671

(22) Filed: Jan. 20, 2000

(30) Foreign Application Priority Data

Jan. 21, 1999 (JP) ..... 11-013539

(51) Int. Cl.[7] ..... H01J 1/30
(52) U.S. Cl. ..... 313/309; 313/351
(58) Field of Search ..... 313/309, 351, 313/496, 336

(56) References Cited

U.S. PATENT DOCUMENTS

| | | | | |
|---|---|---|---|---|
| 5,144,191 A | * | 9/1992 | Jones et al. | 313/308 |
| 5,604,401 A | * | 2/1997 | Makishima | 313/3 |
| 6,043,592 A | * | 3/2000 | Vaudaine | 313/309 |
| 6,075,315 A | * | 6/2000 | Seko et al. | 313/336 |
| 6,137,214 A | * | 10/2000 | Raina | 313/309 |

FOREIGN PATENT DOCUMENTS

| | | |
|---|---|---|
| JP | 06162919 | 6/1994 |
| JP | 7-182966 | 7/1995 |
| JP | 08255556 | 10/1996 |
| JP | 10-12128 | 1/1998 |
| JP | 10-50201 | 2/1998 |
| JP | 10-283913 | 10/1998 |

* cited by examiner

*Primary Examiner*—Sandra O'Shea
*Assistant Examiner*—Anabel Ton
(74) *Attorney, Agent, or Firm*—Young & Thompson

(57) ABSTRACT

Semiconductor layers are formed on a substrate, and an insulating film is formed on the semiconductor layers. On the insulating film is formed a gate electrode, which has emitter holes formed therein. In the emitter holes are formed emitters, which are provided with emitter electrodes via the semiconductor layers. The emitters are grouped into a plurality of emitter groups each having at least one emitter. The emitters of each of the emitter groups are connected to each of the semiconductor layers. Common electrodes are formed across the semiconductor layers via the insulating film. Thereby, a field emission type cold cathode element is obtained which has nonlinear characteristics of providing a low resistance in normal operation and a high resistance upon discharges.

19 Claims, 5 Drawing Sheets

FIELD EMISSION TYPE COLD CATHODE ELEMENT, METHOD OF FABRICATING THE SAME, AND DISPLAY DEVICE

BACKGROUND OF THE INVENTION

1. Field of the Invention

The present invention relates to a field emission type cold cathode element, a method of fabricating the same, and a display device. In particular, the present invention relates to: a field emission type cold cathode element which is formed on a glass substrate and provide a low element resistance in operation and a high element resistance upon electric discharges; a method of fabricating the same; and a display device.

2. Description of the Related Art

Conventionally, field emission type cold cathode elements of Spindt type are known in which acute emitters of cone shape and a gate electrode formed close to the emitters, the gate electrode having submicron openings therein, are used to concentrate high electric fields at the extremities of the emitters so that electrons are emitted in vacuum from the extremities of the emitters to a typically-opposed anode electrode to capture the emission current.

Other elements are also known in which a gate electrode is arranged close to emitters formed of silicon cone elements or materials having smaller work functions, and a field is applied thereto to cause electron emission.

Surface conduction type elements are also known in which an electric current is passed through two electrodes having a minute gap therebetween so that electrons discharged across the gap between the electrodes strike the opposite electrode to cause emission of secondary electrons which are taken into an anode electrode provided in vacuum.

Moreover, in display devices using cold cathode elements, such as a filed emission display (FED), phosphors corresponding to three primary colors, i.e., red, green, and blue are provided in vacuum so as to oppose the emitter, and added with a transparent electrode or thin film metal to form an anode, on which a voltage is impressed to inject emission electrons into the phosphors for light emission. This can provide self-luminous display devices, featuring independence of color properties from view angle.

Among these field emission type cold cathode elements, however, the Spindt type elements in which high electric fields are concentrated at the extremities of the emitters so that electrons are emitted from the extremities of the emitters in vacuum and the elements in which a gate electrode is arranged close to emitters formed of silicon cone elements or materials having smaller work functions and a field is applied thereto to cause electron emission have a problem in that a discharge occurs between the gate and an emitter or between the gate and the anode to end up with a high current, causing breakdown of the element.

An approach to avoid this is to provide high-resistance layers formed of poly-crystalline silicon or amorphous silicon in series with the emitters to prevent the breakdown-causing high current from flowing through the element.

Another approach is to adopt trenching technologies to make trenches, into which insulating films are embedded to form oblong crystal regions surrounded by the insulating films on all sides. This offers nonlinear resistive elements, preventing a high current from flowing (Japanese Patent Application Laid-Open Nos. Hei 10-50201 and Hei 10-12128).

In the case where poly-crystalline silicon or amorphous silicon is used to provide emitters with resistive layers, the resistive layers can be increased in resistance to reduce the current flow upon discharges, thereby improving resistance against the discharge breakdown of the element. The resistive layers, however, are connected in series with the emitters, so that they act as resistances even in normal operation, producing a voltage drop across the resistors. This accordingly increases the operating voltage for driving the element. A problem arises particularly with higher emission currents in that the voltage drop becomes greater to increase the operating voltage.

In contrast, conventional emitters that comprise nonlinear resistive elements adopting the trenching technologies will act as high resistances when a discharge current flows therethrough, whereas they serve as low resistance in normal operation with a smaller effect of voltage drop. In this case, however, the trench structures are formed, e.g., in a silicon single crystal with a trenching depth of 5 $\mu$m or more.

Field emission type cold cathode elements are adapted to a display device by using a glass substrate. Here, it is impossible to grow a single crystal on this glass substrate, and even if poly-crystalline silicon is used instead, a problem arises in that poly-crystalline silicon layers are extremely hard to generate in a thickness of 5 $\mu$m or more.

Besides, the poly-crystalline silicon layers have crystal interfaces, which makes it extreme hard to form satisfactory trench structures. The interfaces also introduce large irregularity among elements, producing a problem in that such elements are not suited to uniformity-requiring devices such as a display.

SUMMARY OF THE INVENTION

An object of the present invention is to provide a field emission type cold cathode element having the nonlinear characteristics of providing a low resistance in normal operation and a high resistance upon discharges even with the use of a glass substrate or the like.

Another object of the present invention is to provide a method of fabricating the same and a display device.

A field emission type cold cathode element according to a first aspect of the present invention comprises: a substrate; a plurality of semiconductor layers formed on said substrate; an insulating film formed on said semiconductor layers; a gate electrode formed on said insulating film; a plurality of emitter holes formed in said gate electrode; emitters formed in said emitter holes; and an emitter electrode connected with said emitters through said semiconductor layers. Said emitters are grouped into a plurality of emitter groups each having at least one emitter. Said emitter or emitters of each of the emitter groups are connected to each of said semiconductor layers. Besides, a common electrode is formed over said semiconductor layers via said insulating film. Said substrate consists of, e.g., a glass substrate.

In the present invention, it is preferable that said common electrode is electrically insulated from said gate electrode and emitter electrode.

Moreover, in the present invention, said gate electrode and said common electrode are preferably formed on the same insulating film.

Furthermore, in the present invention, said semiconductor layers may be formed of poly-crystalline silicon or amorphous silicon. Said insulating film may be formed of: one selected from the group consisting a silicon oxide film, a silicon nitride film, a laminated film having two or more layers of the silicon oxide film and the silicon nitride film and a film of $SiO_xN_{1-x}$ ($0 \leqq x \leqq 1$).

A method of fabricating a field emission type cold cathode element according to a second aspect of the present invention comprises the steps of: forming an emitter electrode on a substrate; forming a semiconductor layer so as to cover said emitter electrode and said substrate; forming an insulating film on said semiconductor layer; forming a metal film on said insulating film before patterning the same to form a gate electrode, an emitter hole, and a common electrode; removing said insulating film exclusive of the forming areas of said gate electrode and said common electrode; and forming an emitter in said emitter hole.

A method of fabricating a field emission type cold cathode element according to a third aspect of the present invention comprises the steps of: forming an emitter electrode on a substrate; forming a semiconductor layer so as to cover said emitter electrode and said substrate; forming an insulating film on said semiconductor layer; forming a metal film on said insulating film before patterning the same to form a gate electrode, an emitter hole, and a common electrode; removing said insulating film from the forming area of said emitter hole; and forming an emitter in said emitter hole.

A display device according to a fourth aspect of the present invention comprises a field emission type cold cathode element according to the first aspect of the present invention.

According to the present invention, emitters are grouped into a plurality of emitter groups each having at least one emitter, semiconductor layers are provided by emitter group, and a common electrode is formed over the semiconductor layers via an insulating film. As a result, when an emitter or emitters increase in electric potential due to a discharge or the like, the electrode functions to suppress electric current via the insulating film. This can suppress abrupt flow of electric current resulting from a discharge or the like.

The nature, principle and utility of the invention will become more apparent from the following detailed description when read in conjunction with the accompanying drawings.

DETAILED DESCRIPTION OF THE PREFERRED EMBODIMENTS

Figure 1:
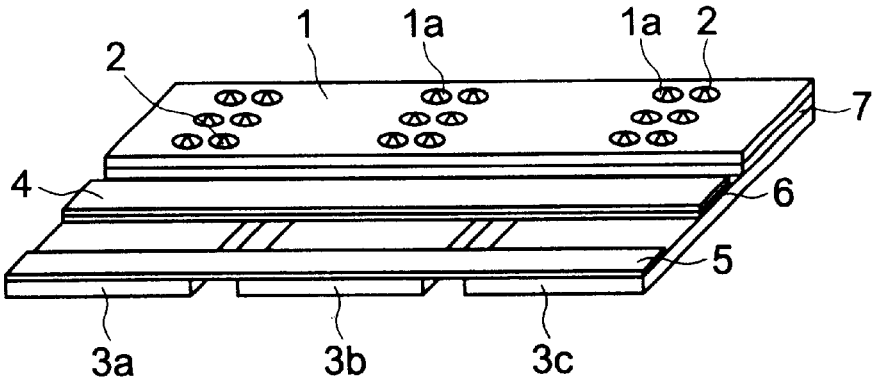
FIG. 1 is a schematic diagram showing the field emission type cold cathode element according to a first embodiment of the present invention.

Hereinafter, preferred embodiments of the present invention will be described with reference to the accompanying drawings. FIG. 1 is a schematic diagram showing the field emission type cold cathode element according to a first embodiment of the present invention.

In the field emission type cold cathode element of the present embodiment, as shown in FIG. 1, a gate electrode 1 has an insulating film 7 formed on its backside. The gate electrode 1 also has a plurality of emitter holes 1*a* formed therein. The emitter holes 1*a* are arranged in three emitter groups, each of which has three rows of adjoining two, i.e., six of the emitter holes. Formed in each of the emitter holes 1*a* is an emitter 2, which is shaped acutely at the extremity. The emitter groups are provided with semiconductor layers 3*a*, 3*b*, and 3*c*, respectively. These semiconductor layers 3*a*, 3*b*, and 3*c* are connected with an emitter electrode 5 in common. Each of the semiconductor layers 3*a*, 3*b*, and 3*c* is also capacitively coupled to a common electrode 4 via an insulating film 6.

Figure 2:
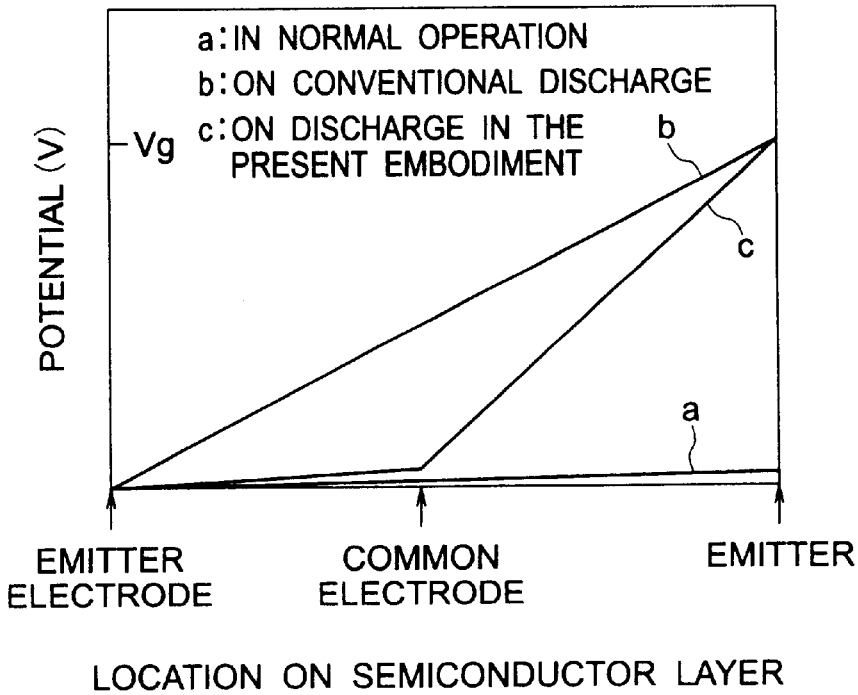
FIG. 2 is a graph on which the ordinate represents electric potential and the abscissa represents location on a semiconductor layer, showing the potentials inside a semiconductor layer.

Next, description will be made of the electric potential in the field emission type cold cathode element having the above-described configuration. FIG. 2 is a graph on which the ordinate represents electric potential and the abscissa location on a semiconductor layer, showing the potentials inside a semiconductor layer. In the figure, the character "a" represents the potential in normal operation, "b" the potential upon conventional discharges, and "c" the potential upon the discharges in the present embodiment. Incidentally, seen in FIG. 2 are the potentials in the central portion of the semiconductor layer 3*b* shown in FIG. 1.

Here, the potential of the gate electrode 1 is given by Vg with the emitter electrode 5 as the ground. In normal operation, as seen in FIG. 2, the resistance of the semiconductor layer 3*b* produces an ascent in voltage so that the voltage gradually rises with increasing distance from the emitter electrode 5.

The relation between parameters is given by the following equation (1):

$$V=Ie\times R \tag{1}$$

where V is the voltage at the emitter, R is the resistance, and Ie is emission current.

When a discharge occurs between the gate electrode 1 and an emitter 2 or between an emitter 2 and the anode, it is lead by local discharges at its early stages. In the case where the discharge is initiated at the emitter 2 on the semiconductor layer 3*b*, the extremity of the emitter 2 becomes equal to the gate electrode 1 in voltage, which results in the potential of the semiconductor layer 3*b* shown by "b" in FIG. 2 when the common electrode 4 and insulating film 6 are absent.

Meanwhile, in the configuration of the present embodiment, the potential of the semiconductor layer 3*b* at the moment of the emitter's discharge is influenced by the presence of the common electrode 4 as shown by "c" in FIG. 2. That is, a sharp rise in voltage will not appear as far as the common electrode 4, thereby decreasing the current flowing into the emitter 2 in accordance with the potential difference between the common electrode 4 and the emitter electrode 5.

Here, the common electrode 4 is capacitively coupled to the remaining semiconductor layers 3*a* and 3*c* via the insulating film 6. The semiconductor layers 3*a* and 3*c* at the emitter 2 side are free from discharges. In addition, the semiconductor layers 3*a* and 3*c* beneath the common electrode 4 have a potential lower potential than Vg. Consequently, even though the potential of the common electrode 4 tends to increase under the influence of the semiconductor layer 3*b* which is involved in the discharge, the capacitive coupling of the common electrode 4 to the other semiconductor layers 3*a* and 3*c* suppresses the increase in potential. Hereby, such a high current as might destroy the element is prevented from flowing even in the cases where a discharge occurs instantaneously.

In addition, the semiconductor layers 3*a*, 3*b*, and 3*c* have depletion layers which expand from beneath the common electrode 4 with increasing potential at the extremities of emitters 2, thereby suppressing a rise in current flow.

While it is capacitively coupled to the semiconductor layers 3*a*, 3*b*, and 3*c*, the common electrode 4 exists independent of the other electrodes i.e. the gate electrode 1 and emitter electrode 5. Thus, in normal operation, even when the potentials of the emitter electrode 5 and gate electrode 1 are changed to control the emission current, all the portions of the common electrode 4 above the semiconductor layers 3*a*, 3*b*, and 3*c* vary in potential so as to be identical with each other, preventing the common electrode 4 from acting as capacitance. Thus, the common electrode 4 exerts no influence in normal operation. Besides, the semiconductor layers 3*a*, 3*b*, and 3*c* can be made of material lower in resistance as compared with the conventional semiconductor layers formed of poly-crystalline silicon or amorphous silicon which have resistive functions. Accordingly, as compares with the conventionals, the series-resistance components to be added to the emitters 2 become smaller to minimize the voltage drops across the resistance parts in normal operation. This can lower the voltage for driving the emitters 2, and reduce the power consumption at the resistance parts.

Figure 3:
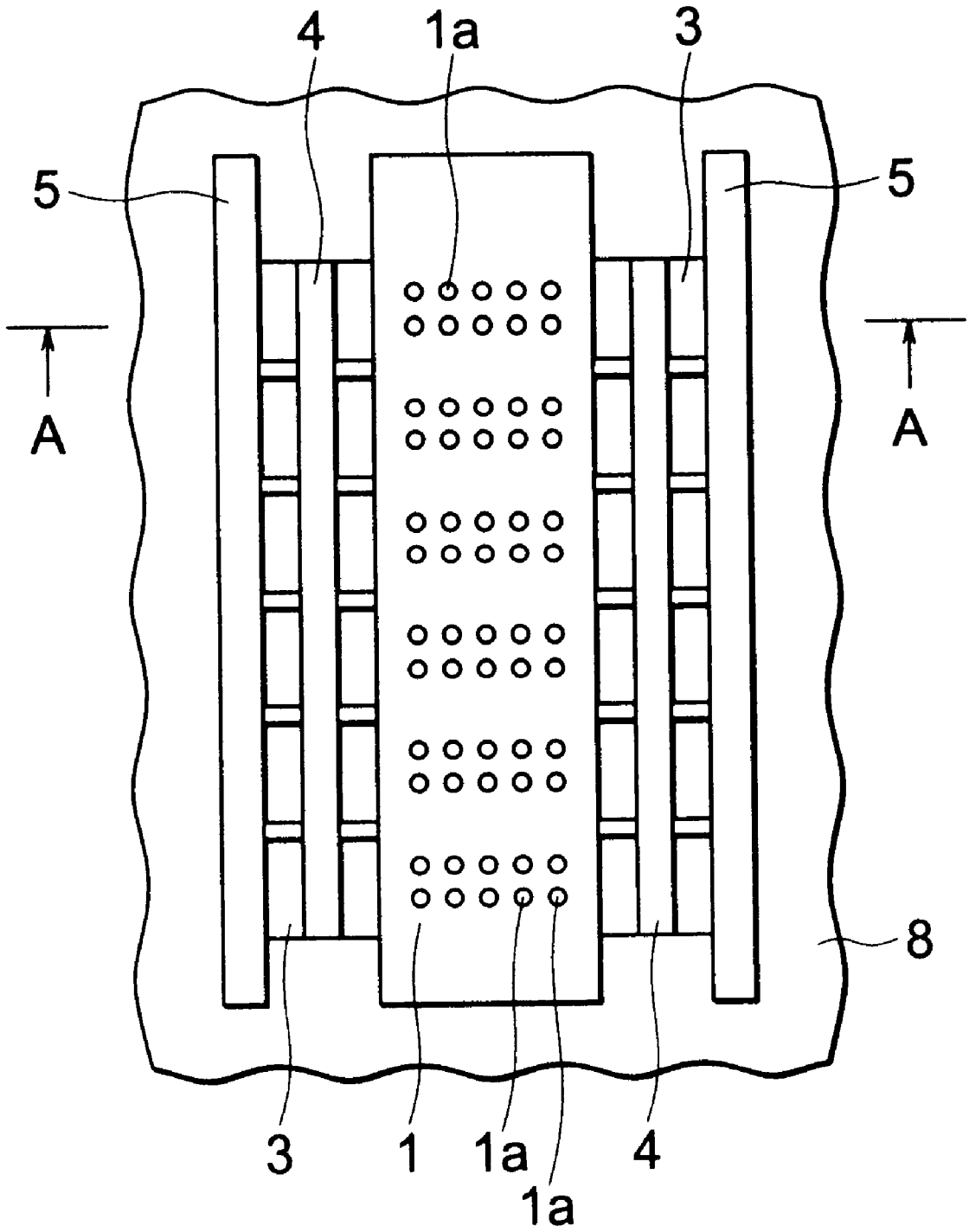
FIG. 3 is a plan view showing the field emission type cold cathode element according to a second embodiment of the present invention.
Figure 4:
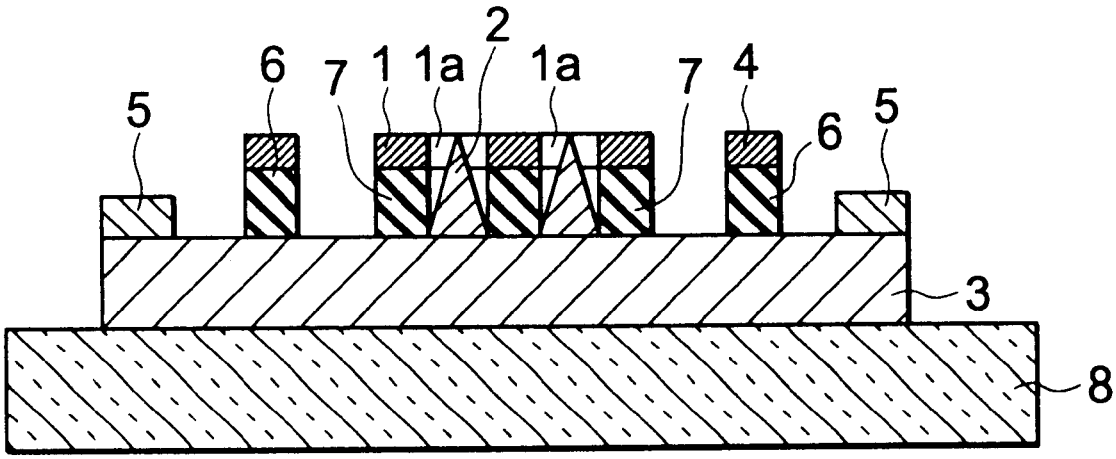
FIG. 4 is a sectional view taken along the line A—A in FIG. 3.

Now, a second embodiment of the present invention will be described in detail with reference to the accompanying drawings. FIG. 3 is a plan view showing the field emission type cold cathode element according to the second embodiment of the present invention. FIG. 4 is a sectional view taken along the line A—A in FIG. 3. Here, the emitters are reduced to two for purpose of simplification.

The field emission type cold cathode element of the present embodiment has emitters of Spindt type. As shown in FIG. 3, a gate electrode 1 has a plurality of emitters 2 and emitter holes 1*a* formed therein. These emitters 2 and emitter holes 1*a* constitute emitter groups. For each of the plurality of emitter groups, a semiconductor layer 3 is formed on the backside of the emitter group so as to extend in a direction orthogonal to the longitudinal direction of the gate electrode 1, in other words, in a lateral direction. None of these semiconductor layers 3 is in contact with adjoining semiconductor layers 3. Here, on both ends of the semiconductor layers 3 are arranged a pair of emitter electrodes 5 with the gate electrode 1 therebetween. Common electrodes 4 are formed between each emitter electrode 5 and the gate electrode 1.

As shown in FIG. 4, the semiconductor layers 3 are formed on a glass substrate 8. The gate electrode 1 is formed over the central portions of the semiconductor layers 3 via an insulating film 7. The gate electrode 1 has the emitter holes 1*a* therethrough. In the emitter holes 1*a* are formed the emitters 2 which are shaped acutely at the extremities. Between the gate electrode 1 and each emitter electrode 5, the common electrodes 4 are capacitively coupled to the semiconductor layers 3 via the insulating films 6. Formed on the both ends of the semiconductor layers 3 are the emitter electrodes 5, which are connected to an emitter current source (not shown). The insulating film 7 has a thickness of 0.3–2 $\mu$m. The thickness of the insulating films 6 is arranged to be equal to or smaller than that of the insulating film 7 formed under the gate electrode 1. The thinner the insulating films 6 are, the stronger their capacitive coupling becomes than the capacitive coupling between the gate electrode 1 and the semiconductor layers 3, which increases the current-suppressing effect. Similarly, the wider the common electrodes 4 are, the stronger the capacitive coupling becomes to enhance the current-suppressing effect.

In the present embodiment, the configuration that the common electrodes 4 are formed via the insulating films 6 over the semiconductor layers 3 divided and formed by emitter group can add the discharge protection function to the emitters 2 formed on the glass substrate 8.

In the present embodiment, the emitter electrodes 5 are formed across the top surfaces of the semiconductor layers 3. However, the present invention is not limited thereto, and may form the emitter electrodes directly on the glass substrate 8 as in a modified example shown in FIG. 5D.

Next, referring to FIGS. 5A through 5D, description will be given of the field emission type cold cathode element of the modified example of the present embodiment. FIGS. 5A–5D are sectional views showing in the order of its steps the method of fabricating the modified example of the field emission type cold cathode element according to the second embodiment of the present invention.

Figure 5A:
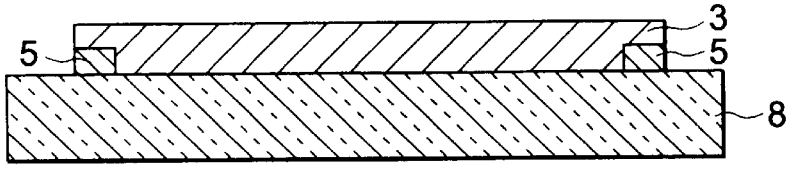
FIGS. 5A through 5D are sectional views showing the method for fabricating a modified example of the field emission type cold cathode element according to the second embodiment of the present invention in the order of its steps.

Initially, as shown in FIG. 5A, a pair of emitter electrodes 5 formed of aluminum are formed on a glass substrate 8. Then, a semiconductor layer 3 formed of e.g. poly-crystalline silicon is formed on the glass substrate 8.

Figure 5B:
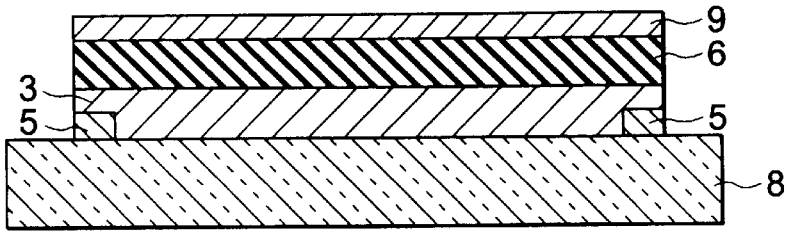

In FIG. 5B, an insulating film 6 formed of e.g. a silicon oxide film is then formed on the semiconductor layer 3. Next, on the insulating film 6 is formed a gate metal film 9 of e.g. tungsten.

Figure 5C:
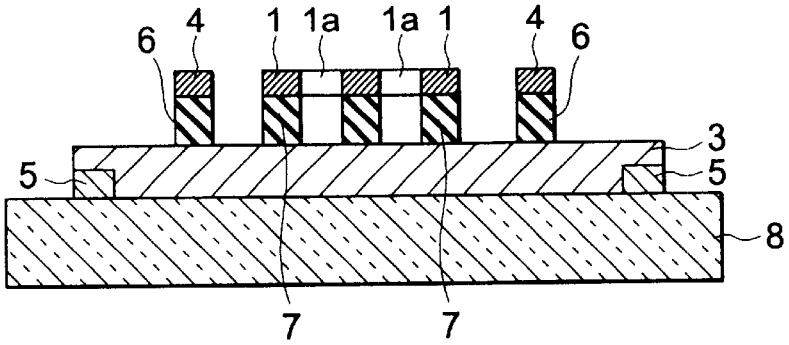

In FIG. 5C, patterning of emitter holes 1*a* and common electrodes 4 is then applied to the gate metal film 9 to form a gate electrode 1, emitter holes 1*a*, and common electrode 4. This is followed by removal of the insulating films 6 exclusive of the forming areas of the gate electrode 1 and common electrodes 4. Thereby, the gate electrode 1 and common electrodes 4 are separated from each other.

Figure 5D:
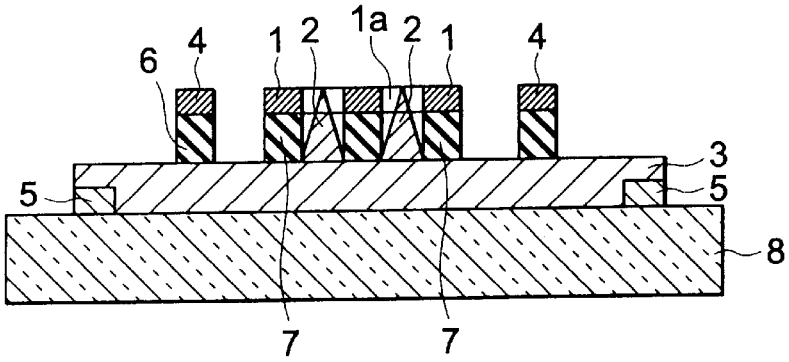

Subsequently, in FIG. 5D, a sacrificial layer (not shown) is deposited over the entire surface of the glass substrate 8. This is followed by oblique deposition of e.g. molybdenum before the sacrificial layer is lift off to form emitters 2. In the steps described above, the field emission type cold cathode element can be formed.

In the present embodiment, the use of the semiconductor layers 3 formed of poly-crystalline silicon or amorphous silicon can add the discharge protection function onto the glass substrate 8 to allow adoption of the same fabricating method as that of liquid crystal displays using conventional active elements. This simplifies the fabrication of field emission type cold cathode elements.

Moreover, while in this modified example the emitter electrodes 5 are formed on the glass substrate, the present invention is not limited to such steps and may include the steps of forming the semiconductor layers 3 on the glass substrate 8, and then forming emitter electrodes 5 across the top surfaces of the semiconductor layers 3.

Figure 6A:
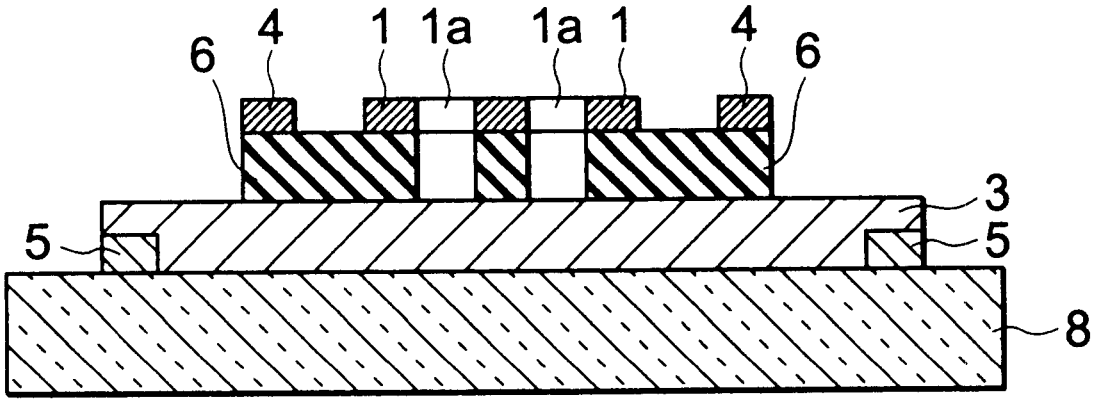
FIGS. 6A and 6B are sectional views showing the method for fabricating the field emission type cold cathode element according to a third embodiment of the present invention in the order of its steps.
Figure 6B:
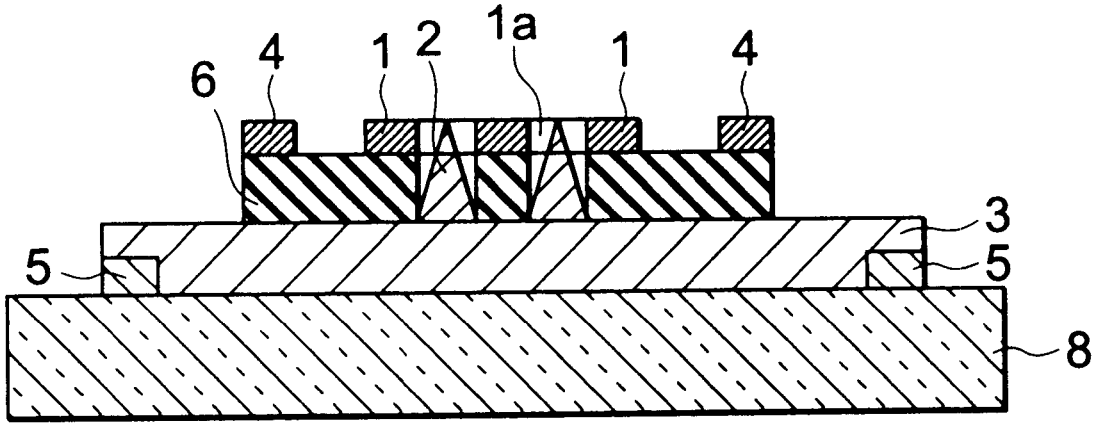

Now, description will be given of a third embodiment of the present invention with reference to FIGS. 6A and 6B. Here, like parts of the second embodiment shown in FIGS. 3, 4, and 5A–5D are designated by like reference numerals, and detailed description thereof will be omitted. FIGS. 6A and 6B are sectional views showing in the order of its steps the method of fabricating the field emission type cold cathode element according to the third embodiment of the present invention.

The present embodiment has the same configuration as that of the second embodiment except in that, as shown in FIG. 6B, the insulating film 6 is not removed from between the gate electrode 1 and the common electrodes 4, in other words, the gate electrode 1 and the common electrodes 4 are formed on the same insulating film 6, and that the emitter electrodes 5 are formed on the glass substrate 8.

In the present embodiment, the semiconductor layers 3 are not exposed between the gate electrode 1 and the common electrodes 4, so that discharges are hard to occur between the gate electrode 1 and the common electrodes 4.

The method of fabricating the field emission type cold cathode element of the present embodiment will now be described with reference to FIGS. 6A and 6B. This fabricating method is identical to that of the modified example of the second embodiment as far as the steps shown in FIGS. 5A and 5B. Thus, description will begin with the next step.

As shown in FIG. 6A, patterning of emitter holes 1*a* and common electrodes 4 is applied to the gate metal film 9 to form a gate electrode 1, emitter holes 1*a*, and common electrodes 4. Then, the insulating film 6 is removed from the areas on the farther sides of the common electrodes 4 from the gate-electrode 1 side. The same steps as that of FIG. 5D follow to form emitters 2. In this way, the field emission type cold cathode element can be formed as shown in FIG. 6B.

In the second and third embodiments, a silicon oxide film is used as the insulating film 6, which allows adoption of chemical vapor deposition or the like to simplify the fabrication. This also results in good adhesion to the semiconductor layers 3 and high workability.

While in the second and third embodiments the emitter electrodes 5 are made of aluminum, the present invention is not limited thereto and may use other materials such as molybdenum, niobium, and chromium. In addition, while the semiconductor layers 3 are made of poly-crystalline silicon, the present invention is not limited thereto and may use other materials such as amorphous silicon. Moreover, while the gate electrode 1 is made of tungsten, the present invention is not limited thereto and may use other materials such as molybdenum, niobium, and silicide.

Furthermore, while in the second and third embodiment the insulating films are made of a silicon oxide film, the present invention is not limited thereto and may use a silicon nitride film, a laminated film of two or more layers of the silicon oxide film and the silicon nitride film, a film of $SiO_xN_{1-x}$, or the like.

In any of the foregoing embodiments, the emitters have been described as of Spindt type. However, the present invention is not limited thereto, and is similarly applicable to planar emitters using diamond, diamond-like carbon, carbon nanotubes, or the like. The present invention is also similarly applicable to surface conduction type elements.

In display devices made by using any of the field emission type cold cathode elements fabricated in the foregoing embodiments, destructive phenomena such as discharges are suppressed to improve reliability.

In the present invention, as has been described in detail, emitters are grouped into a plurality of emitter groups each having at least one emitter, semiconductor layers are provided by emitter group, and a common electrode or electrodes are formed over the semiconductor layers via an insulating film or films, so that the electrode or electrodes function via the insulating film or films to suppress electric current when an emitter rises in potential due to a discharge or the like. This can suppress abrupt flow of electric current resulting from the discharge or the like.

Besides, the aforementioned semiconductor layers formed on a glass substrate can be made of poly-crystalline silicon-or amorphous silicon, eliminating the need for high-resistance semiconductors like conventionals. Accordingly, the layers can act as low resistances in normal operation to suppress the rise of operating voltage and consumption of power.

Moreover, the field emission type cold cathode elements of the present invention can be applied to display devices such as a flat display for further reduction of power consumption.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A field emission type cold cathode element, comprising:

plural nonoverlapping semiconductor layers that are side-by-side and spaced apart from one another;

an insulating film that extends onto all of said semiconductor layers;

a gate electrode on said insulating film;

plural groups of emitters, each of said emitters being in a respective hole that extends through said gate electrode and said insulating film, each of said groups of emitters contacting a different respective one of said semiconductor layers;

an emitter electrode that electrically connects all of said semiconductor layers; and means for capacitively coupling said common electrode to all of said semiconductor layers.

2. The element of claim 1, wherein said means for capacitively coupling comprises a common electrode that overlies all of said semiconductor layers and is separated from said semiconductor layers by an insulator.

3. The field emission type cold cathode element according to claim 1, wherein said common electrode is electrically insulated from said gate electrode and emitter electrode.

4. The field emission type cold cathode element according to claim 1, wherein said gate electrode and said common electrode are formed on the same insulating film.

5. The field emission type cold cathode element according to claim 3, wherein said gate electrode and said common electrode are formed on the same insulating film.

6. The field emission type cold cathode element according to claim 1, wherein said semiconductor layers are formed of poly-crystalline silicon or amorphous silicon.

7. The field emission type cold cathode element according to claim 3, wherein said semiconductor layers are formed of poly-crystalline silicon or amorphous silicon.

8. The field emission type cold cathode element according to claim 4, wherein said semiconductor layers are formed of poly-crystalline silicon or amorphous silicon.

9. The field emission type cold cathode element according to claim 5, wherein said semiconductor layers are formed of poly-crystalline silicon or amorphous silicon.

10. The field emission type cold cathode element according to claim 1, wherein said insulating film is formed of: one selected from the group consisting a silicon oxide film, a silicon nitride film, a laminated film having two or more layers of the silicon oxide film and the silicon nitride film and a film of $$SiO_xN_{1-x}(0 \leqq x \leqq 1).$$

11. The field emission type cold cathode element according to claim 3, wherein said insulating film is formed of: one selected from the group consisting a silicon oxide film, a silicon nitride film, a laminated film having two or more layers of the silicon oxide film and the silicon nitride film and a film of $SiO_xN_{1-x}(0 \leqq x \leqq 1)$.

12. The field emission type cold cathode element according to claim 3, wherein said insulating film is formed of: one selected from the group consisting a silicon oxide film, a silicon nitride film, a laminated film having two or more layers of the silicon oxide film and the silicon nitride film and a film of $SiO_xN_{1-x}(0 \leqq x \leqq 1)$.

13. The field emission type cold cathode element according to claim 5, wherein said insulating film is formed of: one selected from the group consisting a silicon oxide film, a silicon nitride film, a laminated film having two or more layers of the silicon oxide film and the silicon nitride film and a film of $SiO_xN_{1-x}(0 \leqq x \leqq 1)$.

14. The field emission type cold cathode element according to claim 6, wherein said insulating film is formed of: one selected from the group consisting a silicon oxide film, a silicon nitride film, a laminated film having two or more layers of the silicon oxide film and the silicon nitride film and a film of $SiO_xN_{1-x}(0 \leqq x \leqq 1)$.

15. The field emission type cold cathode element according to claim 7, wherein said insulating film is formed of: one selected from the group consisting a silicon oxide film, a silicon nitride film, a laminated film having two or more layers of the silicon oxide film and the silicon nitride film and a film of $SiO_xN_{1-x}(0 \leqq x \leqq 1)$.

16. The field emission type cold cathode element according to claim 8, wherein said insulating film is formed of: one selected from the group consisting a silicon oxide film, a silicon nitride film, a laminated film having two or more layers of the silicon oxide film and the silicon nitride film and a film of $SiO_xN_{1-x}(0 \leqq x \leqq 1)$.

17. The field emission type cold cathode element according to claim 9, wherein said insulating film is formed of: one selected from the group consisting a silicon oxide film, a silicon nitride film, a laminated film having two or more layers of the silicon oxide film and the silicon nitride film and a film of $SiO_xN_{1-x}(0 \leqq x \leqq 1)$.

18. A field emission type cold cathode element comprising:

a substrate;

a plurality of semiconductor layers each having a first surface connected to nonoverlapping said substrate;

a first insulating film having a first surface connected to a second surface of each said semiconductor layers;

a gate electrode connected to a second surface of said first insulating film;

a plurality of groups of emitters, each of said emitters being in a respective emitter hole, each of said emitter groups being connected to said second surface of a different respective one of said semiconductor layers;

an emitter electrode connected to each said second surface of said semiconductor layers;

a second insulating film having a first surface connected to said second surface of said semiconductor layers; and a common electrode connected to a second surface of said second insulating film.

19. The field emission type cold cathode element according to claim 18, wherein said first and second insulating films are a same insulating film.

* * * * *